United States Patent [19]

Cremona

[11] 4,089,354

[45] May 16, 1978

[54] WOOD SHEARING MACHINE

[76] Inventor: Angelo Cremona, V.le Lombardia, 275, Monza, Italy, 20052

[21] Appl. No.: 686,679

[22] Filed: May 17, 1976

[30] Foreign Application Priority Data

May 28, 1975 Italy ..... 23802 A/75

[51] Int. Cl.[2] ..... B27L 5/08

[52] U.S. Cl. ..... 144/178; 144/214; 144/323

[58] Field of Search ..... 144/178, 177, 179, 209 R, 144/321, 323, 309 R, 214

[56] References Cited

U.S. PATENT DOCUMENTS 174,056 2/1876 Bartlett ..... 144/179

2,676,627 4/1954 McFall ..... 144/178

*Primary Examiner*—Othell M. Simpson
*Assistant Examiner*—W. D. Bray
*Attorney, Agent, or Firm*—McGlew and Tuttle

[57] ABSTRACT

There is described a wood shearing machine for the production of veneers, having the wood supporting table with the supporting surface for the wood stock, vertical and running on slideways, alternatively upwards and downwards, characterized in that in addition it has the blade-holding unit placed above the bar-carrying unit and both being slidable on horizontal slideways, the arrangement being such that the cutting operation may take place while the wood stock moves upwards and that the sheet is obtained with the edges turned downwards.

6 Claims, 3 Drawing Figures

WOOD SHEARING MACHINE

BACKGROUND OF THE INVENTION (a) The Field of the Invention

This invention relates, in general, to the construction of wood shearing machines and, in particular, to a new and useful wood shearing machine in which a plate holding unit is movable relatively to a wood stock holder for the purpose of cutting a veneer sheet from the wood stock in a manner deflect it into a path so that its edges are turned downward for facilitating the conveying away of the sheets.

(b) The prior Art

Such an embodiment is a considerable advancement in this field since it enables cutting of the wood stock during its upward stroke (from the bottom to the top-) instead of its downward stroke (from the top to the bottom) as usually happens in vertical or almost vertical wood shearing machines, and therefore enables delivery of the sheets cut arranged with their edges turned downwards.

Such an arrangement of the sheets cut at the outlet of the machine, is very important bacause it enables their automatic transfer to a collecting station or to another machine, without the need to resort to manual operations which are usually necessary if the sheets are upsidedown in coming out of the wood shearing machine, that means with their concave section having the edges turned upwards. This position would not permit piling-up of the sheets because it is possible to put them superimposed on top of each other in a stable equilibrium forming piles reaching even half a meter height, only if the sheets have their edges turned downwards.

However, if the sheets have the edges turned upwards, they are subject to rolling up, particularly if the type of wood is hard or its thickness is small, whereby they have to be subjected to various operations; namely, "un-rolling" them turning them upside down and piling them up by keeping them taut; all these operations being by necessity manual operations usually performed in vertical wood shearing machines by three or more operators.

As a person skilled in the art will readily understand, if it is possible to avoid said manual operations this means having a machine capable of a much higher production yield than the machines of the prior art and consequently the sheets cut by means of this machine are obtained at a lower cost.

Moreover, it has to be stressed that the manual "unrolling" of sheets leads to numerous breakages of said sheets caused by the actual impossibility that the three or four operators handling the sheets can act simultaneously and in a time even less than a second, which would be indispensable in order not to damage the sheets which are always very brittle due to their reduced thickness.

SUMMARY OF THE INVENTION

With the wood shearing machine according to the invention it is possible to obtain, during the same period of time, a higher number than usual of sheets used for veneers, without the risk of breakages and ready for automatic piling-up and transfer to a drier.

The accompanying drawings are given by way of example only, without limitation and show in a side view two possible embodiments of the wood shearing machine according to the invention.

THE VIEWS OF THE DRAWINGS

DETAILED DESCRIPTION OF THE PREFERRED EMBODIMENT

Figure 1:
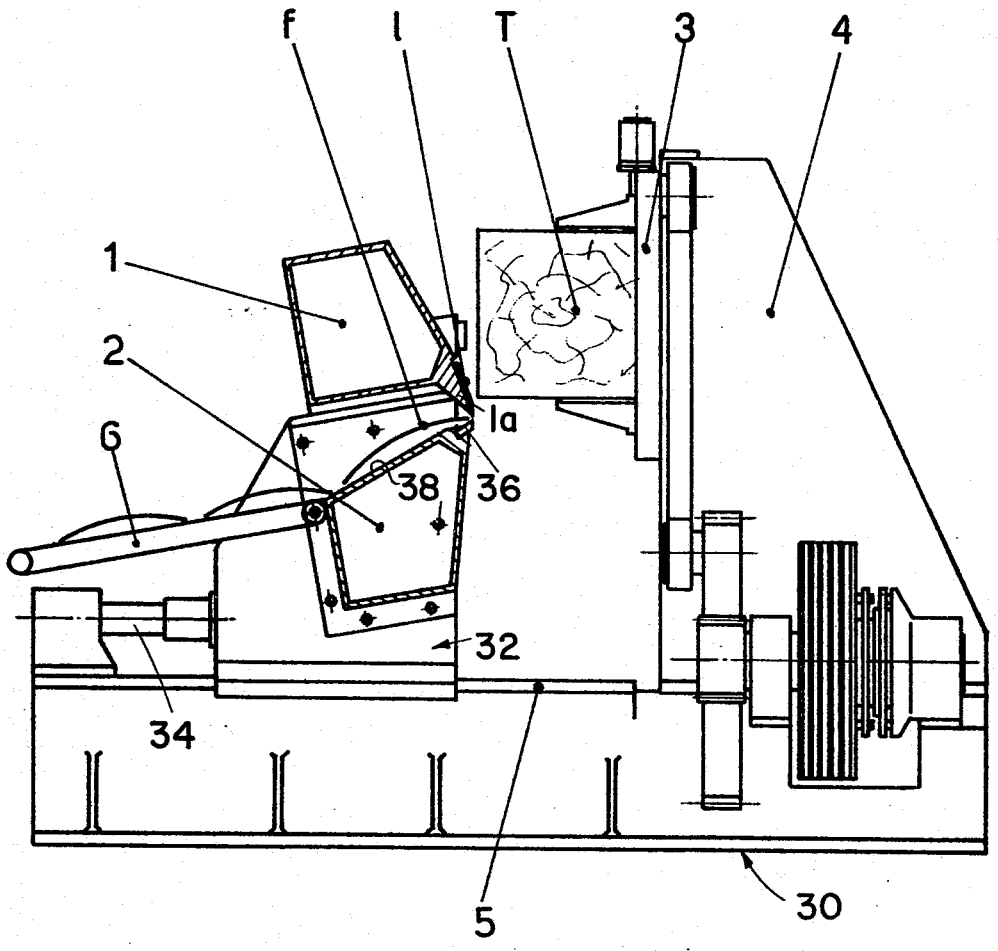
FIG. 1 shows a vertical wood shearing machine.

As may be seen from the drawing, both embodiments comprise a blade-holding unit 1, placed above the bar-carrying unit 2 and the wood supporting table 3 with the wood stock T slides up and down on slideways 4. The assembly comprising the blade-holding unit 1 and the bar-carrying unit 2 also slides on slideways 5. Slideways 4 are obviously perpendicular with respect to slideways 5; and if the former are vertical the latter are horizontal.

In the embodiment shown in FIG. 1, a wood shaving machine mounting base, generally designated 30, includes a vertically extending slide way 4 with a width supporting table 3 and a horizontally extending slideway 5 for the cutting mechanism support unit generally designated 32. The support unit 32 is shifted by a piston rod 34 horizontally backwardly and forwardly along the slide unit 5 for the purposes of advancing or retracting the unit from the wood stock T. The cutting mechanism support unit provides a mounting for a bar carrying unit 2 which contains a counter cutter or bar 36 which is positioned below the knife blade 1 which is carried on the blade holding unit 1. A lower edge 1*a* of the blade holding unit 1 is obliquely oriented so that during each cut the knife blade 1 cuts a uniformly dimensioned strip from the wood stock T when the wood stock T is moved upwardly in relationship to the knife blade 1. The strip or sheet F, which is cut away from the wood stock T, is deflected in an arc by the downward cutting action by the relative upwardly movement of the wood stock T in respect to the knife 1 which, in this embodiment, is held stationary. The strips f are fed over an oblique surface 38 to the conveyor 6 where they may be easily transported away.

Figure 2:
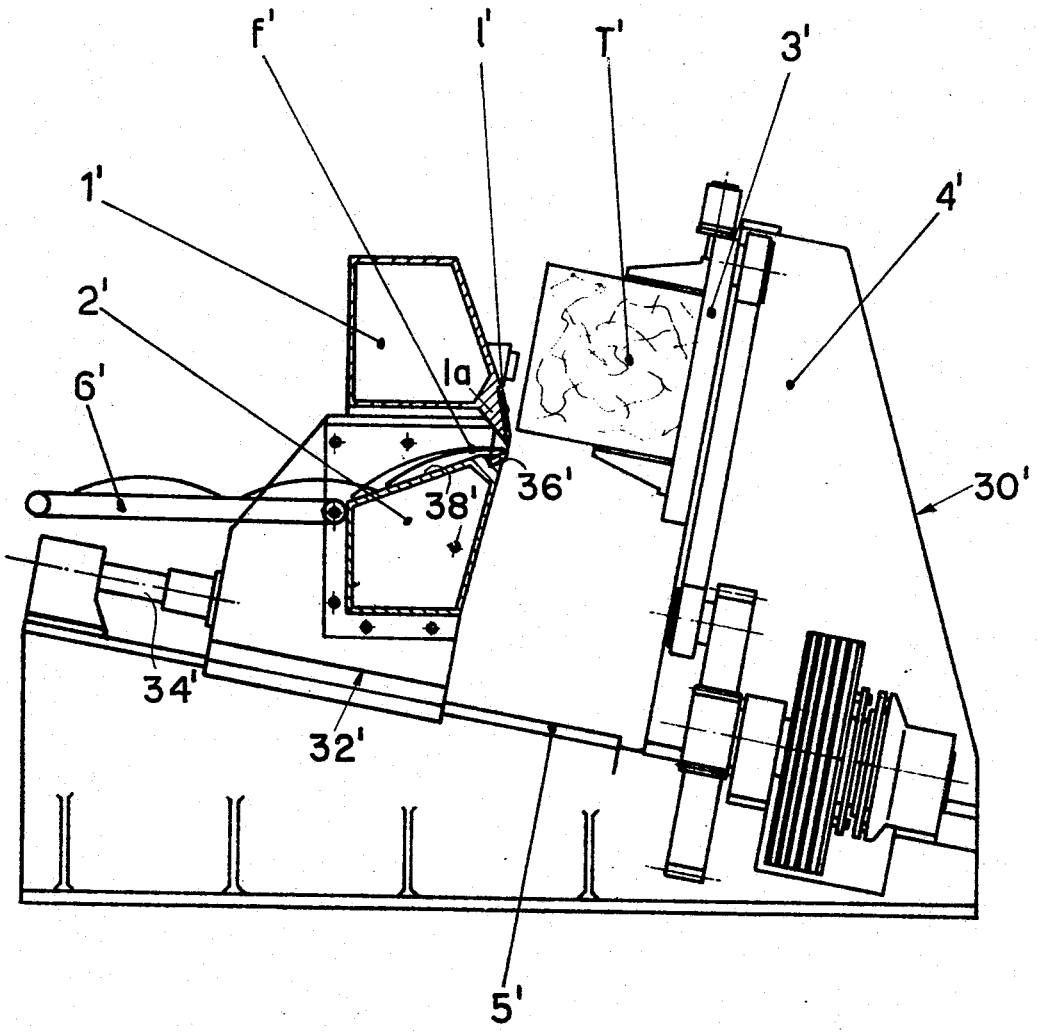
FIG. 2 is a view similar to FIG. 1 showing another embodiment of the invention in which the slide ways for the wood stock holder and for the blade holder are mounted obliquely.

In the embodiment shown in FIG. 2, a wood shearing machine base 30', similar to that of the arrangement shown in FIG. 1, with the exception that the slide ways 4' and 5' which remain at right angles to each other are disposed obliquely, that is, tilted away from the vertical and from the horizontal, respectively.

Figure 3:
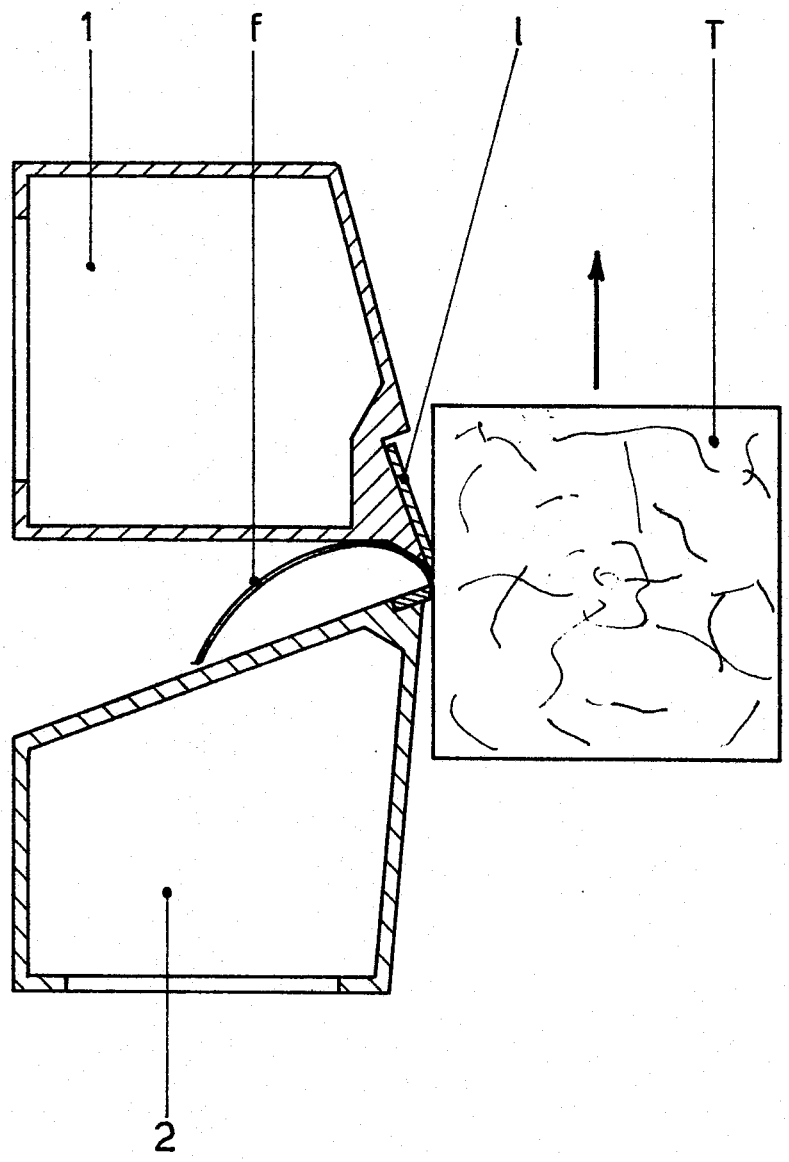
FIG. 3 shows a detail on an enlarged scale of the sheet during the cutting operation.

As may be readily seen from said drawings, since the blade 1 is directed downwards, the sheet cut *f* may be obtained when the wood stock T is directed upwards. This is particularly illustrated in FIG. 3. As best shown in FIG. 3, the invention includes blade holder means 1 mounting said blade L which is shaped generally in an upward arc so that it deflects the strip F into an upwardly curved arcuate form as shown in FIG. 3. The sheet F which is formed as indicated in FIG. 1 then falls down by gravity along a downwardly sloping top edge of the bar carrying unit 2. The sheet F is then moved onto a conveyor belt G and the weight of the sheet itself causes the sheet to tend to flatten out as it is moved. The sheet cut *f* appears, therefore, at the outlet of the machine with its edges turned downwards and may be sent, by means of a lower conveyor belt 6, which is originally provided attached to the bar-carrying unit 2, to the manual or automatic piling-up station or even to the drier.

The sheets cut *f*, thus obtained, with their edges turned downwards are not prone any more to rolling-up, first of all because their own weight tends to flatten them on the transportation surface, and secondly, because the friction encountered by the edges of the sheet on said supporting surface, prevents them from sliding inwardly, this being the cause of their rolling-up.

The guiding and driving means for the moving elements are shown schematically in the drawing and are of a conventional type, since they do not form part of this invention, however, as a person skilled in the art will readily understand, they may be changed without departing from the true scope of the invention.

I claim:

1. A wood shearing machine comprising a machine base, a wood stock holder, first slide means mounting said wood stock holder on said base for movement in upward and downward directions, blade means, blade holder means for mounting said blade means, said blade being mounted obliquely on said blade holder means and having a cutting edge pointing toward said first slide means and projecting outwardly from said holder, second slide means mounting said blade holder means on said base for movement in backward and forward directions at substantially right angles to said woodstock holder for advancing and retracting said blade means in respect to said wood stock holder, said blade holder means with said blade means being anchorable in a fixed location in respect to the movement of said wood stock holder so that said wood stock holder effects the cutting of a strip from a wood stock held by said holder when the wood stock is advanced upwardly within the range of the projecting blade, said blade holder means mounting said blade means being shaped in a generally upward arc deflecting the strip into an upwardly curved arc, and conveyor means disposed adjacent to said blade means and said blade holder means supporting said strip at its edges with said strip being curved upwardly between the edges for feeding away from said blade.

2. A wood shearing machine, according to claim 1, wherein said first slide means extends obliquely in respect to the horizontal and said second slide means extends obliquely to the vertical respectively.

3. A wood shearing machine, according to claim wherein said conveyor means includes a conveyor belt positioned to extend outwardly away from said blade holder in a position to receive the sheets being cut so as to convey them away.

4. A wood shearing device, according to claim 3, wherein said blade holder means includes an oblique surface extending upwardly from the projecting portion of said blade in a position to permit the upward curved movement of of the strips which are cut from the wood stock.

5. A shearing machine for shaving a wood stock comprising a machine base, a wood stock holder adapted to hold the wood stock, first substantially vertical slide means mounting said wood stock holder on said base for movement upwardly and downwardly, a blade a blade holder, an anvil-bar holder carrying structure adjacent said blade holder having a bar projecting outwardly from said holder defining a space between said bar and said blade, said blade being mounted obliquely on said blade holder and having a cutting edge pointing downwardly and toward the stock held by said wood stock holder and spaced above said anvil-bar holder, said blade and said bar projecting outwardly from said blade and said bar holder and toward the wood stock held by said wood stock holder, said blade holder being formed with a portion extending upwardly and away from said blade, second substantially horizontal slide means mounting said blade holder and said anvil-bar holder carrying structure, first actuator means for substantially vertical reciprocation of said wood stock holder and the wood stock held thereby along said first slide means, second actuator means for advancing and retracting said blade holder and anvil-bar holder carrying structure along said second slide means in respect to said wood stock holder, wood strip removing surface and conveyor strip carrying means intermediate said blade holder and said anvil-bar holder defining an inlet portion adjacent to said blade holder portion and together defining a passage shaped to form a wood strip cut from the woodstock in an upwardly curved arc between each edge thereof, whereby any strip cut from said woodstock is carried away from said blade and anvil-bar and progressed on and along said wood strip removing surface and conveyor means in a downwardly facing essentially concave configuration tending to flatten the strip as it is moved thereon.

6. A wood shearing machine, according to claim 5, wherein said anvil bar holder carrying structure defines with said blade holder means a passage progressing downward from said anvil bar holder carrying structure for the feeding of a wood strip, the wood strip being concavely formed and tending to flatten as it is fed along said passage.

* * * * *